United States Patent [19]

Lindner et al.

[11] Patent Number: 4,473,779

[45] Date of Patent: Sep. 25, 1984

[54] POWER FACTOR MEASURING CUT-OFF ARRANGEMENT FOR AND METHOD OF PROTECTING A BALLAST-STARTER CIRCUIT FROM HIGH PRESSURE SODIUM LAMP CYCLING MALFUNCTION

[75] Inventors: Larry A. Lindner, Hackettstown; George Duve, Washington, both of N.J.; Gilman Hallenbeck, West Palm Beach, Fla.

[73] Assignee: Area Lighting Research, Inc., Hackettstown, N.J.

[21] Appl. No.: 381,937

[22] Filed: May 26, 1982

[51] Int. Cl.[3] ..... H05B 37/00

[52] U.S. Cl. ..... 315/119; 315/247; 315/308

[58] Field of Search ..... 315/247, 308, 119

[56] References Cited

U.S. PATENT DOCUMENTS

| | | | |
|---|---|---|---|
| 4,207,500 | 6/1980 | Duve et al. | 315/119 |
| 4,356,433 | 10/1982 | Linden | 315/308 |
| 4,399,392 | 8/1963 | Buhrer | 315/308 |

*Primary Examiner*—Harold Dixon

*Attorney, Agent, or Firm*—Kirschstein, Kirschstein, Ottinger & Israel

[57] ABSTRACT

A cycling cut-off arrangement protects a ballast-starter circuit of a luminaire of the type having a high pressure sodium lamp from damage in the event of a cycling malfunction by sensing the change in power factor across the lamp during cycling, and disabling the ballast-starter circuit from its power source once cycling has been reliably detected. The method of sensing the power factor change, and of disabling the ballast-starter circuit is also disclosed, as well as a method of installing the arrangement on the luminaire with minimum retrofitting required.

16 Claims, 3 Drawing Figures

20
AC TO DC CONVERTER
VOLTAGE SIGNAL GENERATOR
DAY/NIGHT SIGNAL GENERATOR
RESET SIGNAL GENERATOR
COMPARATOR-PROCESSOR
CYCLING CUT-OFF CONTROLLER
CYCLING INDICATOR
CURRENT SIGNAL GENERATOR
BALLAST
STARTER
120VAC
120V AC
+10V DC
VA
SA
SB
SC
SD
SE
SF
SG
SH
SI
SJ
SV
SO
S1
S2
26
28
30
32
40
42
44
46
48
50
52
54
56
58
60
62
64
66
68
70
72
74
76
78
80
24
U1
U2
U3
SCR1
SCR2
Q1
Q2
T1
T2
IL

POWER FACTOR MEASURING CUT-OFF ARRANGEMENT FOR AND METHOD OF PROTECTING A BALLAST-STARTER CIRCUIT FROM HIGH PRESSURE SODIUM LAMP CYCLING MALFUNCTION

BACKGROUND OF THE INVENTION

1. Field of the Invention

The present invention generally relates to luminaires of the type having a high pressure sodium lamp, an electrical power source of voltage and current, and ballast-starter means operatively connected between the power source and the lamp, and normally operative for supplying voltage and current at a predetermined rated power factor across the lamp-ballast-starter combination to light the lamp during nighttime conditions. More particularly, the present invention relates to a power factor measuring cut-off arrangement for and method of protecting the ballast-starter means from damage in the event of a cycling malfunction, wherein the lamp is alternately on and off, and wherein the power source supplies voltage and current to the lamp-ballast-starter combination at a power factor different from said predetermined power factor. A method of installing the power factor measuring cut-off arrangement is also disclosed.

2. Description of the Prior Art

Luminaires having a high pressure sodium lamp and a ballast-starter circuit operatively connected between an electrical power source and the lamp to operate the latter are well known, particularly for streetlighting purposes. The operating characteristics of this sodium lamp are such that, as the lamp ages, some of the electrode material will deposit on the arc tube. This causes the arc tube to retain heat and, in turn, the internal pressure and the arc tube voltage will increase. When the arc tube voltage becomes so high that the ballast-starter circuit can no longer supply it, the lamp goes out. The lamp will restrike after it has cooled down sufficiently. This phenomenon of alternate lighting and extinguishing of the sodium lamp is commonly known as cycling.

Cycling is a major problem in the maintenance of street lighting. The ballast-starter circuit used in conventional luminaires will burn-out if a cycling condition persists for thirty or more days. Unfortunately, it is very difficult to detect if a lamp is cycling in the field. By the time a service person has arrived at the lamp location, the lamp may have come on again. The service person will be very hesitant to remove an operating lamp, because replacement is expensive. Of course, if the cycling lamp is not replaced, the ballast-starter circuit will eventually also have to be replaced, thereby increasing the total maintenance cost of the system.

At present, a lamp replacement maintenance program serves to avoid the cycling problem. An average lamp working lifetime is determined, and the lamps are replaced before this working lifetime has expired. Since different lamps have different aging characteristics, this type of replacement program is a very expensive procedure for solving the cycling problem.

A cycling cut-off arrangement for reliably detecting the existence of a cycling malfunction in the field, and for disabling the power source from the ballast-starter circuit to thereby protect the latter from damage in the event of a cycling malfunction, has been proposed in U.S. Pat. No. 4,207,500, which is assigned to the same assignee as the present invention. Although very reliable for its intended purpose, the cycling cut-off arrangement described in said patent has not proven to be altogether satisfactory for practical reasons, because it proposed to detect the existence of a cycling malfunction by sensing the increase of voltage across the lamp. Cycling was determined when the voltage across the lamp exceeded a threshhold value.

However, this approach proposed that an additional electrical wire be connected from one of the lamp electrodes, and to be routed back to the remaining system components. This additional electrical wiring was very disadvantageous not only due to its extra material cost, but also because of the labor costs involved in retro-fitting an existing luminaire installation. Since each luminaire in a streetlighting system would require such retro-fitting, it will be appreciated that this approach is not the most practical.

SUMMARY OF THE INVENTION

Objects of the Invention

Accordingly, it is the general object of the present invention to overcome the above-mentioned drawbacks of the prior art.

Another object of the present invention is to reliably protect ballast-starter circuits from burn-out in the event of a cycling malfunction without requiring an extensive retro-fit program.

Still another object of the present invention is to reliably detect the existence of a cycling malfunction in the field without requiring an extensive retro-fit program.

Yet another object of the present invention is to substantially reduce the maintenance costs involved in high pressure sodium lamp lighting systems.

An additional object of the present invention is to eliminate additional wiring to be connected to the sodium lamp for the purpose of detecting a cycling malfunction thereof.

A further object of this invention is to provide a cycling cut-off arrangement which is easily installed with minimum material and labor costs in a luminaire.

Another object of this invention is to provide a cycling cut-off arrangement which is miniature in size such that it can fit into a casing of a conventional day/-night switch commonly found on luminaires of the type described herein.

Brief Summary of the Invention

In keeping with these objects and others which will become apparent hereinafter, one feature of the invention resides, briefly stated, in a cycling cut-off arrangement for, and method of, protecting a ballast-starter means from damage in the event of a cycling malfunction wherein the lamp is alternately on and off. The ballast-starter means is mounted in a luminaire of the type having a high pressure sodium lamp and an electrical power source of voltage and current. The ballast-starter means is operatively connected between the power source and the lamp, and the source is normally operative for supplying voltage and current at a predetermined rated power factor across the lamp-ballast-starter combination to light the lamp during nighttime conditions. Typically, the predetermined rated power factor lies somewhere in the range from about 0.5 lagging to about 0.94 leading and, more particularly, usually is around 0.8 lagging in normal operation when the lamp is on at night.

In accordance with this invention, we have recognized that the power factor of an extinguished lamp-ballast-starter combination during cycling is different from that of the aforementioned predetermined power factor. For example, during cycling, the power factor would typically be below 0.17 lagging or below 0.94 leading. Hence, this invention proposes sensor means for detecting the predetermined power factor across the lamp-ballast-starter combination, and for generating a cut-off signal when the detected power factor is different from said predetermined power factor; and further proposes control means responsive to the generation of the cut-off signal for disabling the power source from the ballast-starter means to thereby protect the latter from damage in the event of a cycling malfunction.

In accordance with the above-recited features of the present invention, the ballast-starter means is reliably protected from burn-out. By disabling the ballast-starter circuit from the power source as soon as the cycling condition is detected, conventional burn-out problems are safely and reliably avoided.

More importantly, the sensor means and control means of the cycling cut-off arrangement of this invention do not require any additional electrical wire to be connected to one of the lamp electrodes. If the power source is considered to be at one upstream end of a current path, and if the lamp is considered to be at the opposite downstream end of the current path, than the cycling cut-off arrangement of this invention is connected upstream of the lamp, rather than downstream of the lamp as in the cut-off arrangement described in the aforementioned patent. Only two wires are connected between the cycling cut-off arrangement and the lamp-ballast-starter combination and, as noted above, the elimination of a third wire reduces material and labor costs significantly.

Even more importantly, in accordance with a preferred embodiment of this invention, the sensor means and the control means are miniaturized in size so that they can fit into a casing of a conventional day/night switch commonly found on luminaires of the type described herein. This makes the retro-fit of existing luminaire installations extremely simple and cost effective, because all the service person need do is replace the existing day/night switch casing with a casing in accordance with the present invention which, of course, includes not only the conventional day/night switch, but also the cut-off arrangement.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENT

Figure 1:
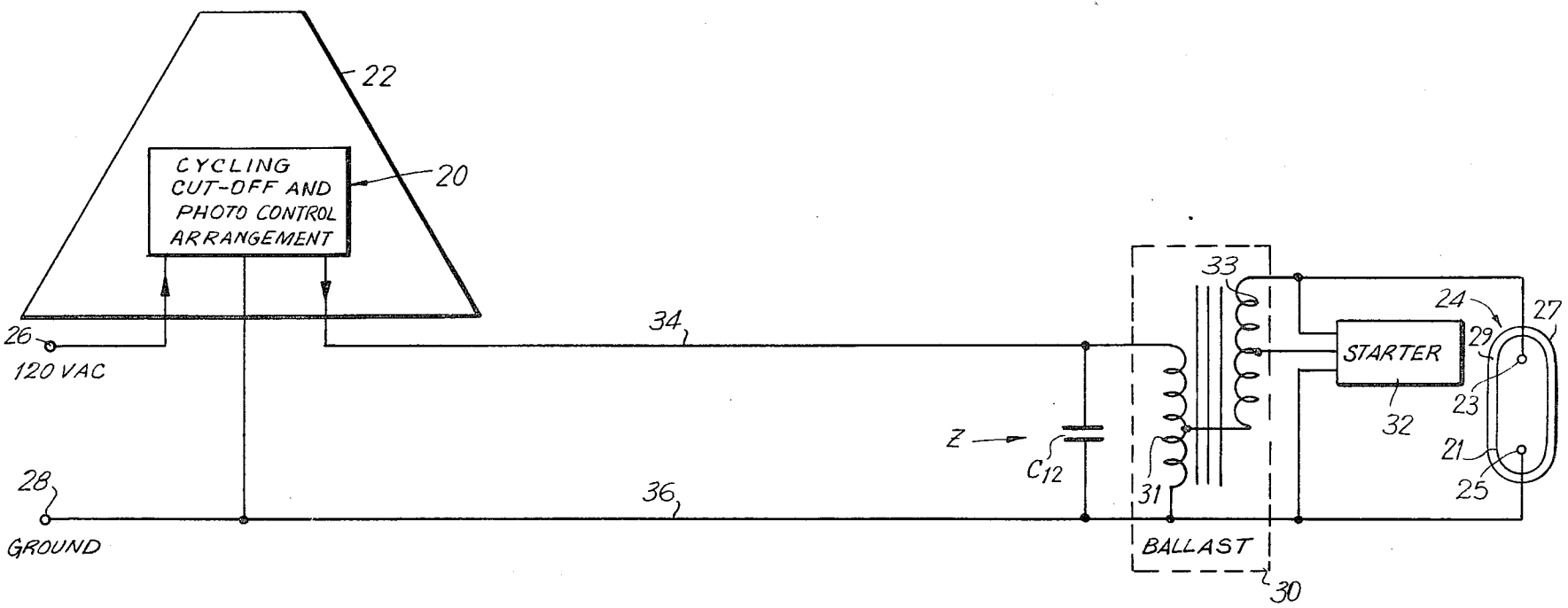
FIG. 1 is a diagram of a cycling cut-off arrangement in accordance with this invention as mounted in a casing of a conventional day/night photocontrol switch and as connected to a conventional ballast-starter circuit of a luminaire of the type having a high pressure sodium lamp.

Referring now to the drawings, and in particular to FIG. 1 thereof, reference numeral 20 generally identifies a cycling cut-off and photocontrol arrangement mounted in a photocontrol casing 22 which is conventional in luminaires of the type having a high pressure sodium lamp 24, an electrical power source of voltage and current which is supplied at input terminals 26 and 28, and a ballast 30 and a starter 32 which are operatively connected between the power source and the lamp. A pair of electrically conductive wires 34,36 are routed from the cycling cut-off and photocontrol arrangement 20 to the ballast-starter-lamp combination.

The lamp 24 comprises an arc tube 21 having an interior space which is partially filled with a sodium amalgam. Electrodes 23,25 are located at opposite end regions within tube 21. Small amounts of other substances such as mercury and argon are also enclosed within tube 21 to facilitate arcing when the proper voltage is applied across the electrodes 23,25. A thermally-insulating glass envelope 27 surrounds the tube 21 with clearance 29. This clearance area is evacuated and serves to maintain the tube 21 hot.

The ballast-starter circuit is conveniently connected in cascade with the lamp 24 in order to limit the current to a magnitude which will not destroy the lamp, particularly under starting conditions. The ballast 30 has a primary coil 31 connected across power correction factor capacitor $C_{12}$, and a secondary coil 33 one end of which is connected to some point of the primary coil 31 in auto-transformer fashion, the location of the tap being dependent upon the input voltage rating of the ballast. The starter 32 is connected between the opposite end of the secondary coil 33 and ground, and has another input terminal connected to some point on the secondary coil 33, the location of this tap being dependent upon the input voltage rating of the ballast. This ballast-starter circuit is entirely conventional in this art, and the source is operative for supplying voltage and current at a predetermined rated power factor across the lamp-ballast-starter combination to light the lamp during nighttime conditions.

As described above, and in detail in the aforementioned patent, as the lamp ages, some of the electrode material, typically tungsten, will deposit on the arc tube. The inner wall of the tube 21 becomes coated with the tungsten film, and this causes the aging tube to lose less heat as compared to a new tube. The resulting temperature increase raises the internal pressure and concomitantly raises the arc tube voltage until, eventually, the ballast-starter circuit can no longer supply the voltage, and the lamp is extinguished. The extinguished lamp will restrike only if it has cooled down. The alternate lighting and extinguishing of the lamp is commonly known as cycling, and is a major problem in luminaires, because the ballast-starter circuit will burn-out if cycling persists for very long. One full cycling cycle can last for ten minutes or more and, hence, it is difficult to economically detect cycling in the field, because a service person would have to wait for a fully cycling cycle to be completed before being sure that the lamp needs to be replaced.

We have recognized that cycling can be reliably detected without connecting additional wiring to the electrodes of the lamp 24 by detecting a change in the power factor condition across the lamp-ballast-starter combination. The power factor is a measure of the shift of phase angle $\theta$ that exists between the lamp voltage and the lamp current waveforms. The power factor is a function of cosine $\theta$. Ideally, for a purely resistive load, the phase shift between a voltage and current waveform is zero and, hence, the power factor is one. The greater the difference in phase shift between the voltage and current waveforms, the lower the power factor. The power factor can be leading or lagging. The lagging power factor will decrease from one for an all-resistive load to zero for an all-inductive load. The leading power factor will decrease from one for an all-resistive load to zero for an all-capacitive load.

In a typical luminaire, the impedance Z looking into the ballast-starter-lamp combination is part-resistive and part-reactive. When the lit lamp is in steady state operation, the impedance is more resistive than reactive, and the power factor can lie anywhere in the range from about 0.94 leading to about 0.5 lagging. Typical power factors are on the order of 0.8 lagging. Since the utility companies object to inefficient energy utilization, the lamp-ballast-starter combination is typically designed not to have a power factor less than 0.5 lagging or 0.94 leading. By contrast, in some luminaires, when the lamp is extinguished during cycling, the impedance is virtually all inductive, and the power factor of the ballast-starter-lamp combination is much lower than 0.5 lagging, and typically is less than 0.1 lagging. In other luminaires, when the lamp is extinguished during cycling, the impedance is part-capacitive, and the power factor of the ballast-starter-lamp combination is lower than 0.94 leading.

In accordance with the arrangement and method of this invention, the change in power factor is detected, and a cut-off signal is generated. This cut-off signal is then processed to disable the power source from the ballast-starter circuit to protect the same during cycling. The cycling lamp is, in a preferred embodiment, permanently shut-off, thereby making it easy for a service person to visually spot and replace the lamp in the field.

Figure 2:
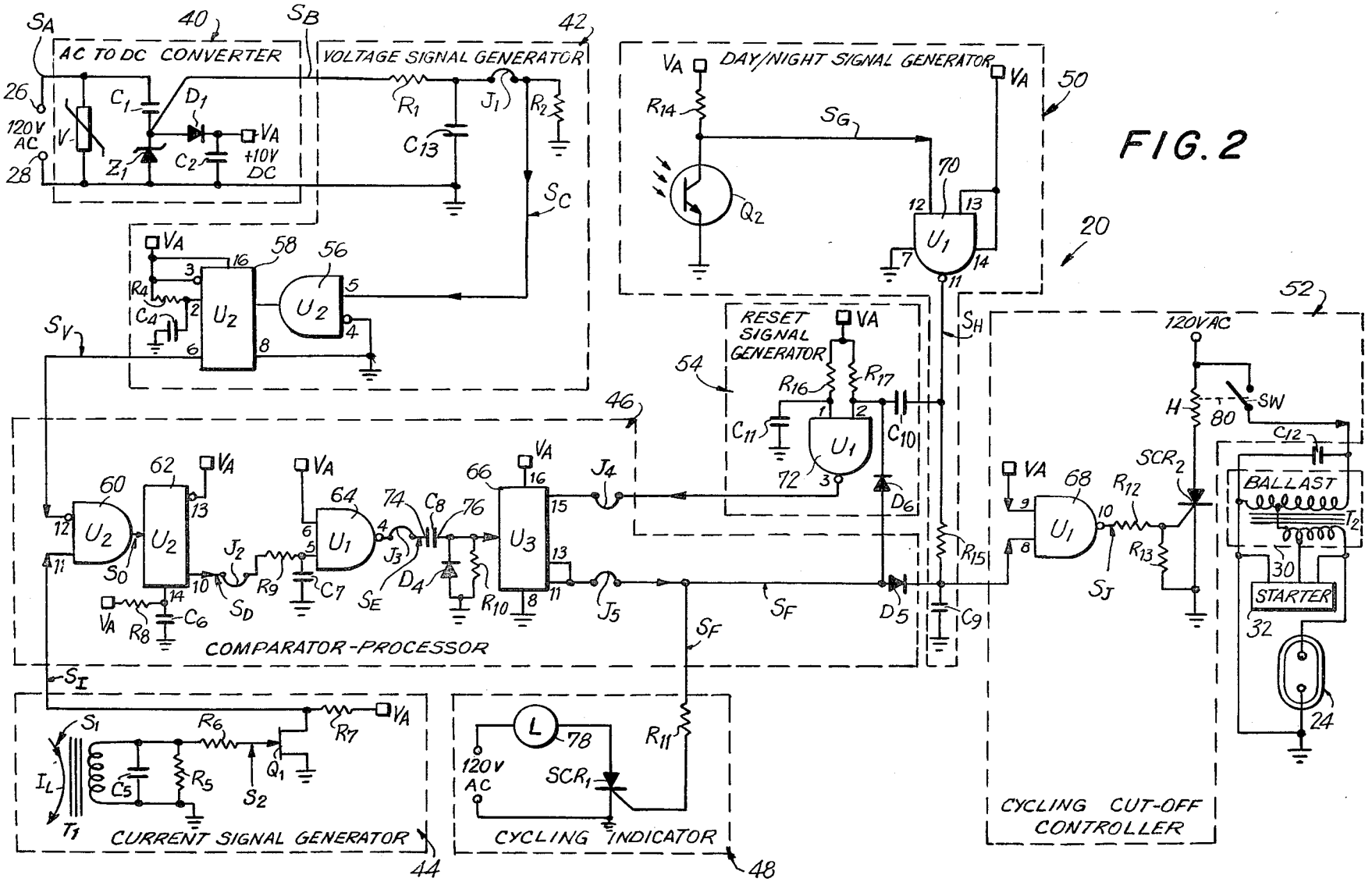
FIG. 2 is an electrical schematic diagram of the cycling cut-off arrangement in accordance with the method of this invention as shown in FIG. 1.

As shown in FIG. 2, the arrangement 20 comprises a plurality of electrical sub-circuits, including an AC to DC converter 40, a voltage signal generator 42, a current signal generator 44, a comparator-processor 46, a cycling indicator 48, a day/night signal generator 50, a cycling cut-off controller 52, and a reset signal generator 54. In a preferred embodiment, all of these sub-circuits are mounted on two printed circuit boards which are interconnected by the diagrammatically illustrated jumper wires $J_1$ through $J_5$. In addition, various multi-element integrated circuit chips have been used, and the elements of at least one chip have been used in more than one sub-circuit. Hence, in order to clarify the drawings and the following description, the elements of the chips have been spaced apart of each other.

The converter 40 includes a surge protecting varistor V connected across AC input terminals 26,28. A voltage-dropping capacitor $C_1$, and a clamping zener diode $Z_1$ are together connected across the varistor. A rectifying diode $D_1$ is connected at the zener diode output. A filter capacitor $C_2$ connects the diode $D_1$ output to ground. An output terminal $V_A$ is connected to the output of diode $D_1$. In operation, the capacitor $C_1$ drops the line voltage, and the zener diode clamps the voltage to about 10 volts. The rectifying diode and the filter capacitor tend to remove voltage ripples. The output terminal $V_A$ is, in turn, utilized to supply DC voltage to all other terminals in the arrangement which have been identified by the $V_A$ designation.

Figure 3:
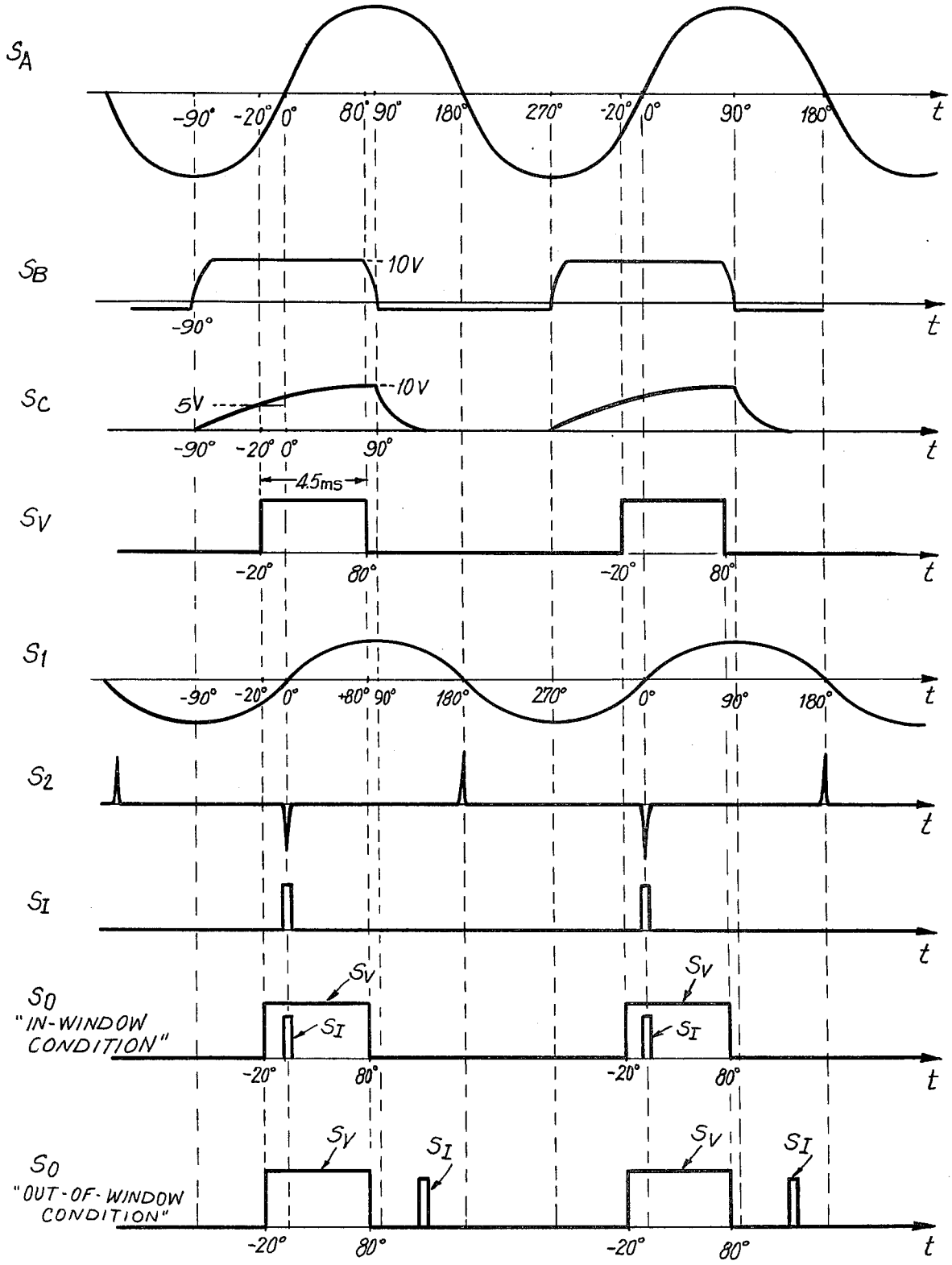
FIG. 3 is a schematic diagram of some of the signal wave-forms that are generated in the cycling cut-off arrangement of FIG. 2.

The AC voltage signal $S_A$ (see FIG. 3) is supplied to the converter 40, and the voltage signal $S_B$ (see FIG. 3) at the cathode of the clamping zener diode $Z_1$ is clamped at 10V when the voltage is at 10V or higher. The clamped voltage signal $S_B$ is then conducted to the voltage signal generator 42, whereupon the voltage signal $S_B$ is initially time delayed by the time delay sub-circuit comprised of the voltage divider resistors $R_1$ and $R_2$ and of the time delay capacitor $C_{13}$. The time constant of the time delay sub-circuit is deliberately selected such that the resulting time-delayed voltage signal $S_C$ (see FIG. 3) reaches one-half of the clamped voltage at a first predetermined phase angle. As shown in FIG. 3, the time-delayed signal $S_C$ reaches 5V at $-20°$. As will be explained below, to a phase shift of $-20°$ corresponds to a leading power factor of about 0.94.

The time-delayed voltage signal $S_C$ is, in turn, conducted to input terminal 5 of an integrated circuit chip $U_2$, Model No. CD4098B sold by the RCA Corporation. Chip $U_2$ is a sixteen terminal chip, and the various elements thereof have been separately diagrammatically shown as elements 56,58,60,62. The numbers next to each terminal represent the correspondingly numbered terminal on the chip. Hence, the time-delayed voltage signal $S_C$ is conducted to elements 56 and 58 which are operative to generate the voltage-derived signal $S_V$ shown in FIG. 3 at output terminal 6. The element 56 is operative to trigger the counter element 58 when the element 56 senses that the time-delayed signal $S_C$ has risen past the half-way point, i.e. 5V, which corresponds to the first predetermined angle of $-20°$. The elements 56,58 serve as a retriggerable one-shot which generates a high state when the signal $S_C$ has reached the first predetermined angle, and maintains this high state for a built-in time delay which is determined by a timing resistor $R_4$ and a timing capacitor $C_4$. The timing resistor $R_4$ and capacitor $C_4$ have been deliberately chosen such that the high state of the voltage-derived signal lasts for a predetermined time period, e.g. on the order of 4.5 milliseconds, and terminates at a second predetermined angle, i.e. on the order of 80°. As will be explained below, a phase shift of 80° corresponds to a power factor on the order of about 0.17 lagging. This voltage-derived digital-type signal $S_V$ is then conducted to the inverted input terminal 12 of element 60, which serves as a comparator, as described below.

As shown in FIG. 3, in a preferred embodiment, the high state of the voltage-derived signal $S_V$ exists from about $-20°$ to about $+80°$; the low state exists at all other times; and this repeats for every cycle. The $-20°$ first predetermined phase angle for the high state was selected by the time delay components $R_1$, $R_2$ and $C_{13}$. The 80° second predetermined angle for the high state was selected by the timing components $R_4$ and $C_4$. A phase shift in the range from $-20°$ to $+80°$ corresponds to power factors which are in the range from about 0.94 leading to about 0.17 lagging. A phase shift less than $-20°$, or greater than $+80°$, respectively, corresponds to power factors which are less than 0.94 leading, or less than 0.17 lagging. As discussed above, the power factors of the ballast-starter-lamp combination from about 0.94 leading to about 0.17 lagging correspond to the lit lamp condition during normal operation (with a safety factor), and the power factors of the ballast-starter-lamp combination less than 0.94 leading, or less than 0.17 lagging correspond to the extinguished lamp cycling condition.

Turning now to the current signal generator 44, the current $I_L$ going through lamp 24 is shown in FIG. 3 by the $S_1$ waveform. This current is detected by a saturated transformer $T_1$ which goes out of saturation only in the vicinity of zero current crossings. The current signal $S_1$ is processed through filter capacitor $C_5$ and voltage divider resistors $R_5$ and $R_6$ to generate the voltage spike signal $S_2$ shown in FIG. 3. This spike signal is fed to a field effect transistor $Q_1$ which is biased to be on all the time and generate a low state signal, except when a negative-going voltage spike is supplied thereto, in which case, the transistor $Q_1$ opens, and a high state signal is generated. The resulting lamp current-derived signal $S_I$ (see FIG. 3) is then conducted to input terminal 11 of comparator 60 where it is compared with the voltage-derived signal $S_V$ to generate the comparator output signal $S_O$, which can have wither one of two conditions.

The so-called "in-window" condition is shown in FIG, 3 and, in this case, the high state of the current-derived signal occurs concurrently with the high state of the voltage-derived signal. This signifies that the current-derived signal $S_I$ either (a) lags the voltage derived signal $S_V$ by a phase angle which is somewhere between 0° and 80°, or, in other words, the power factor of the ballast-starter-lamp combination lies somewhere between 1.0 and 0.17 lagging; or (b) leads the voltage-derived signal $S_V$ by a phase angle which is somewhere between 0° and −20°, or, in other words, the power factor of the ballast-starter-combination lamp lies somewhere between 1.0 and 0.94 leading, thereby signifying that the lamp is in normal operation.

As for the so-called "out-of-window" condition shown in FIG. 3, this occurs when the high state of the current-derived signal occurs concurrently with the low state of the voltage-derived signal. This means that the current-derived signal $S_I$ either (a) lags the voltage derived signal $S_V$ by a phase angle which is somewhere between 80° and 90°, or in other words, that the power factor of the ballast-starter-combination lamp is less than 0.17 lagging; or (b) leads the voltage derived signal $S_V$ by a phase angle which is somewhere between −20° and −90°, or, in other words, the power factor of the ballast-strater-lamp combination is less than 0.94 leading, thereby signifying that the lamp is extinguished and is cycling.

The comparator output signal $S_O$ is then processed by logic element 62 whose terminal 13 is biased with a negative DC voltage, and whose terminal 14 is positively biased through biasing resistors $R_8$ and biasing capacitor $C_6$. Logic element 62 is operative to generate a first processing signal $S_D$ at output terminal 10 which has a low state when the comparator output signal $S_O$ is in its in-window condition, and which has a high state when the comparator output signal $S_O$ is in its out-of-window condition.

The first processing signal is then conducted through buffer resistor $R_9$ and buffer capacitor $C_7$ to input terminal 5 of element 64 of another integrated circuit chip $U_1$ such as Model No. MC14093BCP sold by the Motorola Corporation. Chip $U_1$ is a fourteen terminal chip, and its various elements have been identified as elements 64,68,70,72 in FIG. 2. Element 64 is essentially a NAND gate whose input terminal 6 is always biased to the high state, and is operative to generate a second processing signal $S_E$ which has a high state when output terminal 10 of chip $U_2$ is low, and which has a low state when output terminal 10 of chip $U_2$ is high. Element 64 serves as a buffer, and generates the second processing signal $S_E$ after a time delay determined by the buffer resistor and capacitor. In a preferred embodiment, this time delay is on the order of 8 seconds.

The second processing signal $S_E$ is applied to plate 74 at the left side of pulsing capacitor $C_8$. The plate 76 at the right side of pulsing capacitor $C_8$ is biased in steady state operation to be in the low state by grounding diode $D_4$ and grounding resistor $R_{10}$. The pulsing capacitor $C_8$ is operative to generate a pulse only when plate 74 changes from the low to the high state. This occurs when the comparator output signal $S_O$ changes from the out-of-window to the in-window condition. Hence, a pulse is generated by capacitor $C_8$ only when an extinguished cycling lamp restrikes to be lit.

The pulse is conducted to input terminal 14 of counter chip $U_3$ which is preferably a 16 pin integrated circuit chip sold by the RCA Corporation as Model No. CD4022, whose terminal 16 is positively biased, whose terminal 8 is grounded, whose reset terminal 15 is normally biased with a low state signal during counting, and whose output terminals 11 and 13 are tied together. The counter 66 is preferably designed to store four counts, and to generate a counter output signal $S_F$ having a high state at its output only after four pulses have been applied to input terminal 14. It will be recognized that the counter could have been designed to store any number of counts before generating a high state for its counter output signal. However, we have selected four counts in order to be very certain that a cycling lamp has attempted to restrike four times during a single nighttime condition, as discussed below. Hence, the output of counter 66 will be in the low state in normal operation, or even after one, two, or three pulses have been counted by counter 66. However, after the fourth pulse has been counted, then the counter output signal will be in the high state.

The blocking diode $D_5$ blocks the low state of the counter output signal from reaching the cycling cut-off controller 52. However, when the counter output signal is in the high state, thereby indicating that the lamp 24 is indeed cycling, then the high counter output signal, also known as the cut-off signal, is conducted to input terminal 8 of NAND gate 68.

At the same time the cut-off signal is conducted through current-limiting resistor $R_{11}$ to the gate of the silicon controlled rectifier $SCR_1$ to trigger the normally-off rectifier to the on condition and, in turn, to energize the cycling indicator light 78. Inasmuch as the cut-off signal stays high, the indicator light stays on, thereby continuously indicating to a service person that the lamp 24 has failed, and should be replaced.

Before discussing the operation of the controller 52, it is appropriate to discuss the operation of the day/night signal generator 50 which has a phototransistor $Q_2$ whose collector is positively biased through current-limiting resistor $R_{14}$, and whose emitter is grounded. The phototransistor detects the ambient light intensity, and generates a photocell output signal $S_G$ having a low state when a daylight condition is detected, and a high state when a nighttime condition is detected.

The photocell output signal is conducted to input terminal 12 of logic element 70 of chip $U_1$. Element 70 is a NAND gate whose input terminals 13 and 14 are tied together and always biased to the high state, and whose terminal 7 is grounded. The gate 70 generates a day/night signal $S_H$ which is in a high state at daylight, and in a low state at night. The day/night signal is conducted to time delay resistor $R_{15}$ and time delay capacitor $C_9$, both of which serve to protect against lightning flashes. The day/night signal is conducted to input terminal 8 of the NAND gate 68 of the cycling cut-off controller 52.

During normal daytime operation, the high day/-night signal at input terminal 8 generates a control signal $S_J$ at output terminal 10 which has a low state due to the fact that input terminal 9 of gate 68 is always in the high state. The low control signal is conducted to the gate of the normally-off silicon controlled rectifier $SCR_2$, and does not trigger the latter on. A heater element H is connected between the power source and the normally-off rectifier. Hence, no current flows through the heater either. Also, the normally-open control switch SW which is operatively connected to the heater along the diagrammatically illustrated line-of-action 80 remains open. Inasmuch as the control switch is connected in series between the power source and the ballast-starter circuit for the lamp 24, the open control switch insures that the lamp 24 will stay off during the day.

During normal nighttime operation, the low day/-night signal at input terminal 8 generates a high state for the control signal $S_J$. This high control signal is conducted through current-limiting resistor $R_{12}$ to the rectifier gate, which is connected to ground by grounding resistor $R_{13}$, and is operative to trigger the rectifier into conduction. This causes current to flow through the heater, thereby causing the latter to heat the thermally-operated control switch and to close the latter. The closed control switch permits the power source to be connected to the ballast-starter circuit and, in turn, causes the lamp to light during the night.

However, when the lamp is cycling at night, the high counter output signal $S_F$ will be applied to the input terminal 8 of gate 68, rather than the low day/night signal, because the low day/night signal will be attenuated by resistor $R_{15}$, and hence, the high counter output signal will control the operation of the lamp. As noted above, a high signal at the input terminal 8 will cause the lamp 24 to go out, and this is exactly the desired result when a lamp has been determined to be cycling. Inasmuch as the counter output signal stays high, the lamp will remain off.

Turning now to the reset signal generator 54, it will be recalled that the counter 66 will count as long as a low state signal is applied to reset terminal 15. The counter 66 will reset when a high state signal is applied to reset terminal 15.

The reset signal generator includes a NAND gate which is element 72 of chip $U_1$. The input terminals 1 and 2 are connected through current-limiting resistors $R_{16}$ and $R_{17}$ to a high state voltage. Hence, in steady state operation, both input terminals 1 and 2 are high, and the output terminal 3 which is connected to reset terminal 15 is low, thereby not causing the counter to reset.

However, in the event that power is interrupted and then restored, as in the case of power resumption after a power failure, or as in the case of system reconnection after system maintenance, then the input terminal 1 will momentarily be at the low state due to the presence of the time delay capacitor $C_{11}$. This causes the output of gate 72 to be momentarily high, thereby causing the counter 66 to be automatically reset after power resumption.

In a preferred embodiment of this invention it is also desirable to reset the counter every evening at dusk. Hence, when the phototransistor $Q_2$ detects the change from daylight to nighttime, the day/night signal $S_H$ at the output of gate 70 changes from the high to the low state, as described above. The day/night signal is conducted through coupling capacitor $C_{10}$ to input terminal 2 of gate 72. Inasmuch as input terminal 1 of gate 72 is in the high state in steady state operation, the change of the day/night signal from a high to a low state causes the input terminal to similarly change from a high to a low state, thereby causing the signal applied to the reset terminal to change from a low state to a high state and, in turn, automatically resetting the counter 66.

The blocking diode $D_6$ is an optional feature. If the blocking diode is omitted, then the counter will be reset every evening at dusk as described above. If the blocking diode is connected as shown between input terminal 2 of gate 72 and output terminals 11 and 13 of counter 66, then the counter will not reset every evening at dusk if the counter output signal $S_F$ is in the high state. If the counter output signal $S_F$ is in the low state because less than four counts have been detected then the counter will continue to reset every evening at dusk even if the blocking diode $D_6$ is connected as shown.

In summary, a voltage-derived signal and a current-derived signal are generated and compared as to how much the current-derived signal lags or leads the voltage-derived signal in order to determine the power factor, i.e. phase displacement condition of the ballast-starter-lamp combination. When the power factor changes from one value in the lamp-off cycling condition to a different value in the lamp-on cycling condition, this change in power factor condition is detected. Inasmuch as a single change might be due to noise on the line, the buffer element 64 introduces a time delay on the order of 8 seconds or so, such that the change in power factor can be confirmed for a great many cycles during the time delay of the buffer. Then, once the power factor remains changed during an 8 second time period, this situation must be repeated a plurality of times, e.g. four times, in the course of a single night, or otherwise, the counter will be automatically reset.

We have found that the following components and values are preferred for the embodiment of FIG. 2: For the resistors $R_1$, $R_2$, and $R_4$ through 17: 20, 470, 150, 4.7, 4.7, 100, 300, 1000, 470, 15, 15, 8.2, 100, 1000, 470, and 470 kilohms, respectively. For the capacitors $C_1$, $C_2$, $C_4$ through $C_{11}$, and $C_{13}$: 0.15, 100, 0.1, 0.002, 0.1, 3.3, 0.01, 3.3, 0.01, 3.3, and 0.1 microfarads, respectively. As for zener diodes $Z_1$ and $Z_2$, we prefer to use Model No. IN758. As for the diode $D_1$, we prefer to use Model No. IN4005. As for diodes $D_4$, $D_5$ and $D_6$, we prefer to use Model No. IN914.

It will be understood that each of the elements described above, or two or more together, may also find a useful application in other types of constructions differing from the types described above.

While the invention has been illustrated and described as embodied in a power factor measuring cycling cut-off arrangement for and method of protecting a ballast-starter circuit from high pressure sodium lamp cycling malfunction, as well as a method of installation of the arrangement, it is not intended to be limited to the details shown, since various modifications and structural changes may be made without departing in any way from the spirit of the present invention.

For example, rather than using the three integrated circuit chips $U_1$, $U_2$, $U_3$ and all the other system components, the entire arrangement can be incorporated into a single microprocessor chip. In addition, the arrangement can be operated at voltages other than 120 volts AC.

As clearly shown in the drawings, no additional wire is connected to one of the lamp electrodes and routed back to the arrangement 20 for the purpose of detecting a cycling malfunction. This invention detects a variable electrical characteristic which is upstream of the lamp, and senses this variation in the electrical characteristic to shut-off the cycling lamp. In the preferred embodiment described above, the power factor was selected as the variable characteristic. However, it will be appreciated that other upstream variable electrical characteristics could have been selected, e.g. the line wattage, and that this is also within the spirit of the present invention.

It will be further understood that the power factor detected by the present invention is the power factor as seen across the entire light fixture system which includes the lamp itself, the ballast, the starter, and any other electrical component involved with the light fixture.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and equivalence of the following claims.

What is claimed as new and desired to be protected by Letters Patent is set forth in the appended claims:

1. In a luminaire of the type having a high pressure sodium lamp, an electrical power source of voltage and current, and ballast-starter means operatively connected between the power source and the lamp, said power source being normally operative for supplying voltage and current at a predetermined rated phase displacement condition across the lamp and ballast-starter means to light the lamp during nighttime conditions, a cycling cut-off arrangement for protecting the ballast-starter means from damage in the event of a cycling malfunction, wherein the lamp is alternately on and off, and wherein the power source supplies voltage and current to the lamp and ballast-starter means at a phase displacement condition different from said predetermined phase displacement condition, said cycling cut-off arrangement comprising:

(a) sensor means for detecting the plase displacement condition across the lamp and ballast-starter means, and for generating a cut-off signal when the detected phase displacement condition is different from said predetermined phase displacement condition; and (b) control means responsive to the generation of the cut-off signal for disabling the power source from the ballast-starter means to thereby protect the latter from damage in the event of a cycling malfunction.

2. The cycling cut-off arrangement as defined in claim 1, wherein the sensor means includes voltage signal generator means for generating a two-state voltage signal derived from the source voltage; current signal generator means for generating a current signal derived from the current; comparator means for generating a comparator output signal in which the current-derived signal is concurrent with one state of the voltage-derived signal during a lamp-on condition, and in which the current-derived signal is non-concurrent with said one state of the voltage-derived signal during a lamp-off condition; and processor means responsive to the generation of the comparator output signal, for generating the cut-off signal when the current-derived signal changes at least once from its position in said lamp-off condition to its position in said lamp-on condition.

3. The cycling cut-off arrangement as defined in claim 2, wherein said one state of the voltage-derived signal has a time duration which delimits said predetermined rated phase displacement condition, and wherein the other state of the voltage-derived signal has a time duration which delimits said different phase displacement condition.

4. The cycling cut-off arrangement as defined in claim 3, wherein the voltage signal generator means includes means for converting an analog source voltage to a two-state voltage-derived signal having a digital-type configuration.

5. The cycling cut-off arrangement as defined in claim 3, wherein said one state of the voltage-derived signal has time duration in which the phase angles therein range from $-20°$ to about $80°$.

6. The cycling cut-off arrangement as defined in claim 2, wherein the current signal generator means generates the current-derived signal at a zero crossing of the current.

7. The cycling cut-off arrangement as defined in claim 6, wherein the current signal generator means includes means for converting the analog current to a pulse-type digital signal.

8. The cycling cut-off arrangement as defined in claim 2, wherein the sensor means also includes buffer means for delaying the response of the processor means to the generation of the comparator output signal.

9. The cycling cut-off arrangement as defined in claim 2, wherein the processor means includes counter means for counting each time the current-derived signal changes its position from the lamp-off condition to the lamp-on condition, and wherein the processor means generates the cut-off signal only after the counter means has counted a predetermined number of changes during one nighttime condition.

10. The cycling cut-off arrangement as defined in claim 9, wherein the luminaire also includes a day-night sensor for detecting daylight and nighttime conditions, and wherein the sensor means further includes reset means for resetting the counter means each time the day-night sensor detects the change from a daylight to a nighttime condition.

11. The cycling cut-off arrangement as defined in claim 9, wherein the sensor means further includes reset means for resetting the counter means upon power resumption after a power failure or reconnection after system maintenance.

12. The cycling cut-off arrangement as defined in claim 1; and further comprising indicator means for continuously indicating that a cycling malfunction has occurred and that the ballast-starter means has been disabled.

13. The cycling cut-off arrangement as defined in claim 1, wherein the control means includes a thermally-operated switch operatively connected to the ballast-starter means, and normally closed during nighttime conditions; and heater means responsive to generation of the cut-off signal, and operative for opening the switch to disable the ballast-starter means.

14. The cycling cut-off arrangement as defined in claim 1, wherein the cycling cut-off arrangement is mounted within a casing mounted on the luminaire in spaced relation to the lamp and ballast-starter combination; and wherein only two wires are connected between the casing and the lamp-ballast-starter combination to span the distance therebetween.

15. A method of protecting from damage a ballast-starter means of a luminaire of the type having a high pressure sodium lamp energizable by an electrical power source operative for supplying voltage and current to the lamp and the ballast-starter means at a predetermined rated phase displacement condition during nighttime conditions, in the event of a cycling malfunction, wherein the lamp is alternately on and off, and wherein the power source spplies voltage and current to the lamp and the ballast-starter means at a phase displacement condition different from said predetermined phase displacement condition, said method comprising the steps of:

(a) detecting the phase displacement condition across the lamp and the ballast-starter means, and generating a cut-off signal when the detected phase displacement condition is different from said predetermined phase displacement condition; and (b) disabling the power source from the ballast-starter means in response to the generation of the cut-off signal to thereby protect the ballast-starter means from damage in the event of a cycling malfunction.

16. The method as defined in claim 15, wherein the detecting step is performed by generating a two-state voltage signal derived from the source voltage; generating a current signal derived from the current; generating a comparator output signal by combining the voltage-derived and current-derived signals such that the current-derived signal is concurrent with one state of the voltage-derived signal during a lamp-on condition, and such that the current-derived signal is non-concurrent with said one state of the votage-derived signal during a lamp-off condition; and generating, in response to the generation of the comparator output signal, the cut-off signal when the current-derived signal changes at least once from its position in said lamp-off condition to its position in said lamp-on condition.

* * * * *